US008747158B2

(12) United States Patent
Szczesny et al.

(10) Patent No.: US 8,747,158 B2
(45) Date of Patent: Jun. 10, 2014

(54) ELECTRICAL CONNECTOR HAVING GROUNDING MATERIAL

(75) Inventors: David S. Szczesny, Hershey, PA (US); John J. O'Keefe, II, Lewisberry, PA (US); Douglas M. Thomas, Mechanicsburg, PA (US); Eric David Briant, Dillsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 177 days.

(21) Appl. No.: 13/527,346

(22) Filed: Jun. 19, 2012

(65) Prior Publication Data

US 2013/0337667 A1 Dec. 19, 2013

(51) Int. Cl.
*H01R 4/66* (2006.01)

(52) U.S. Cl.
USPC ..... 439/607.07

(58) Field of Classification Search
USPC ..... 439/92, 91, 71, 73, 86, 607.02, 607.03, 439/607.08
See application file for complete search history.

(56) References Cited

U.S. PATENT DOCUMENTS

| | | | | |
|---|---|---|---|---|
| 6,183,301 | B1 * | 2/2001 | Paagman | 439/607.05 |
| 6,299,484 | B2 * | 10/2001 | Van Woensel | 439/607.07 |
| 6,371,813 | B2 * | 4/2002 | Ramey et al. | 439/607.05 |
| 6,386,924 | B2 * | 5/2002 | Long | 439/701 |
| 6,655,966 | B2 * | 12/2003 | Rothermel et al. | 439/76.1 |
| 6,743,057 | B2 * | 6/2004 | Davis et al. | 439/701 |
| 6,884,117 | B2 * | 4/2005 | Korsunsky et al. | 439/607.11 |
| 7,503,804 | B2 * | 3/2009 | Minich | 439/607.05 |
| 8,167,631 | B2 * | 5/2012 | Ito et al. | 439/108 |
| 8,529,300 | B2 * | 9/2013 | Ritter et al. | 439/701 |
| 2002/0123266 | A1 * | 9/2002 | Ramey et al. | 439/608 |
| 2012/0184140 | A1 * | 7/2012 | Davis et al. | 439/607.34 |
| 2013/0102192 | A1 * | 4/2013 | Davis | 439/607.07 |

* cited by examiner

*Primary Examiner* — Neil Abrams
*Assistant Examiner* — Phuongchi T Nguyen

(57) ABSTRACT

An electrical connector is provided having a housing. Contact modules are positioned within the housing. The contact modules each have a dielectric body holding at least one conductive lead. The at least one conductive lead extends between a mating end and a mounting end. The mating end is configured to be electrically connected to an electrical component. The mounting end is configured to be electrically connected to a circuit board. Ground plates are positioned within the housing between corresponding contact modules. The contact modules and the ground plates form a contact assembly held by the housing. A conductive elastomeric material extends through the contact modules and engages the ground plates to electrically interconnect the ground plates.

17 Claims, 6 Drawing Sheets

ELECTRICAL CONNECTOR HAVING GROUNDING MATERIAL

BACKGROUND OF THE INVENTION

The subject matter described herein relates to an electrical connector.

Multiport electrical connectors generally include a plurality of contact modules and ground plates stacked within a housing. The contact modules include conductive leads held within a dielectric body. The connector is mounted to a primary circuit board and receives a secondary circuit board through a mating end. The ground plates of the connector are coupled to a ground plane within the primary circuit board. The ground plates provide electrical shielding between the leads of the contact module to reduce cross-talk between the conductive leads.

However, conventional multiport connectors are not without their disadvantages. In particular, the ground plates are typically only electrically connected through the primary circuit board. Through the connector, the ground plates are electrically isolated from one another. Some known multiport connectors include a conductive pin that conductively couples the ground plates. Unfortunately, the pin may require significant force to be inserted into the connector. The force required to insert the pin may damage the connector. Additionally, the pin may not make contact with each of the ground plates positioned within the connector housing. Moreover, debris from the insertion of the pin may collect within the connector. Accordingly, the performance of the connector may be reduced and/or the connector may be non-functional.

A need remains for a multiport connector that conductively couples the ground plates positioned therein.

SUMMARY OF THE INVENTION

In an exemplary embodiment, an electrical connector is provided having a housing. Contact modules are positioned within the housing. The contact modules each have a dielectric body holding at least one conductive lead. The at least one conductive lead extends between a mating end and a mounting end. The mating end is configured to be electrically connected to an electrical component. The mounting end is configured to be electrically connected to a circuit board. Ground plates are positioned within the housing between corresponding contact modules. The contact modules and the ground plates form a contact assembly held by the housing. A conductive elastomeric material extends through the contact modules and engages the ground plates to electrically interconnect the ground plates.

In another embodiment, an electrical connector is provided having a housing. Contact modules are positioned within the housing. The contact modules each have a dielectric body holding at least one conductive lead. The dielectric body has at least one contact module opening therethrough. The at least one conductive lead extends between a mating end and a mounting end. The mating end is configured to be electrically connected to an electrical component. The mounting end is configured to be electrically connected to a circuit board. Ground plates are positioned within the housing between corresponding contact modules. The contact modules and the ground plates form a contact assembly held by the housing. The ground plates have at least one ground plate opening therethrough. The ground plates are arranged within the contact assembly such that the contact module opening is aligned with the ground plate opening to fond a ground channel extending through the ground plates and the contact modules. A conductive elastomeric material extends through the ground channel to electrically connect the ground plates.

In another embodiment, an electrical connector is provided having a housing. Contact modules are positioned within the housing. The contact modules each have a dielectric body. The dielectric body has at least one contact module opening therethrough. A pair of conductive leads is held by the dielectric body. The conductive leads are spaced by a gap. The at least one contact module opening is formed in the gap between the conductive leads. The conductive leads extend between a mating end and a mounting end. The mating end is configured to be electrically connected to an electrical component. The mounting end is configured to be electrically connected to a circuit board. Ground plates are positioned within the housing between corresponding contact modules. The contact modules and the ground plates form a contact assembly held by the housing. The ground plates have at least one ground plate opening therethrough. The ground plates are arranged within the contact assembly such that the contact module opening is aligned with the ground plate opening to form a ground channel extending through the ground plates and the contact modules between the conductive leads. A conductive elastomeric material extends through the ground channel to electrically connect the ground plates.

BRIEF DESCRIPTION OF THE DRAWINGS

The presently disclosed subject matter will be better understood from reading the following description of non-limiting embodiments, with reference to the attached drawings, wherein below.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Embodiments described herein include a multiport connector having a conductive elastomeric material extending therethrough. The conductive elastomeric material conductively couples each of the ground plates within the connector, while the conductive leads within the connector remain insulated from the ground plates. The conductive elastomeric material improves the performance of the connector by improving grounding and/or shielding between the conductive leads of the connector. Additionally, the conductive elastomeric material may reduce cross-talk within the connector, and in particular, between the conductive leads.

It should be noted that although the embodiments described herein are described with respect to a multiport connector, the embodiments may be used with any suitable connector.

Figure 1:
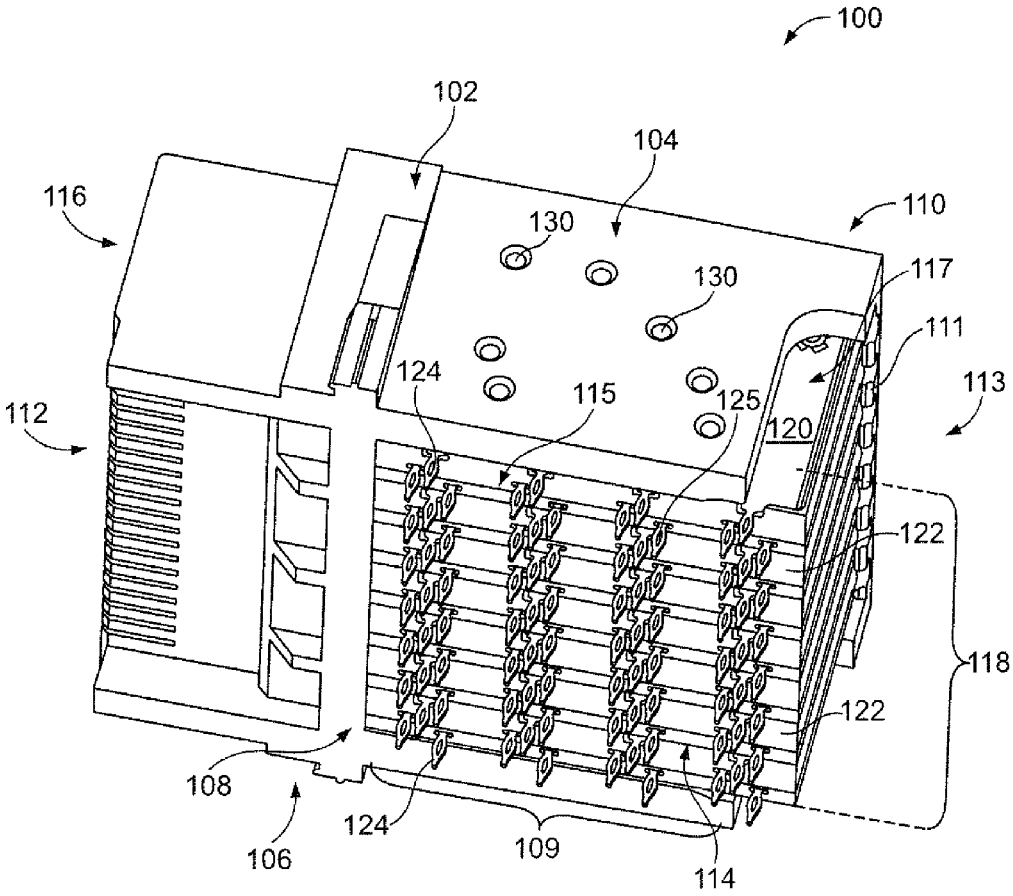
FIG. 1 is a side perspective view of a multiport connector formed in accordance with an embodiment.

FIG. 1 is a side perspective view of a multiport connector 100 formed in accordance with an embodiment. The connector 100 includes a housing 102 having a side 104 and an opposite side 106. A bottom 108 and a top 110 extend between the side 104 and the side 106. A front 112 and a back 113 also extend between the side 104 and the side 106.

A cavity 109 is formed within the housing 102. The cavity 109 is formed between the side 104 and the side 106 of the housing 102 and extends from the bottom 108 to the top 110 of the housing 102 between the front 112 and back 113 of the housing 102. The cavity 109 includes an opening 115 along the bottom 108 of the housing 102 and an opening 117 along the back 113 of the housing 102.

A mounting end 114 is defined along the bottom 108 of the connector 100. The mounting end 114 is configured for mounting to a primary substrate (not shown), for example, a mother board. A mating end 116 is defined along the front 112 of the connector 100. The mating end 116 is configured for mating with an electrical component. For example, the mating end 116 may define card edge connector slots that receive secondary substrates (not shown), for example daughter cards or the like. The mating end 116 may be configured to receive an electrical connector, contact modules and/or cables or cable mounted connectors in alternative embodiments. The electrical connector 100 electrically couples the primary substrate with the electrical component.

A contact assembly 118 is positioned within the housing 102. The contact assembly 118 is at least partially loaded into the cavity 109. In an exemplary embodiment, the contact assembly 118 may be retained within the housing 102 by a plurality of tabs 111. In the illustrated embodiment, the tabs 111 are formed along the top 110 of the housing 102 and extend along the back 113 of the housing 102. Alternatively, the tabs 111 may be formed along the side 104 and/or side 106 of the housing 102 or in other locations.

The contact assembly 118 includes a plurality of ground plates 120 and contact modules 122. The ground plates 120 and the contact modules 122 are positioned adjacently within the housing 102. The ground plates 120 and contact modules 122 are positioned between the side 104 and the side 106 of the connector 100. In the illustrated embodiment, the contact assembly 118 includes one ground plate 120 and two contact modules 122 arranged in units in a ground-signal-signal pattern. The ground plates 120 and the contact modules 122 are positioned from the side 104 to the side 106 such that two contact modules 122 are positioned between each of the ground plates 120. For example, the ground plates 120 and the contact modules 122 are positioned from the side 104 to the side 106 in the order of ground plate 120, contact module 122, contact module 122. The order of the ground plates 120 and the contact modules 122 is then repeated throughout the housing 102. In alternative embodiments, the contact assembly 118 may include any number of contact modules 122 and ground plates 120 in any suitable order.

The ground plates 120 and the contact modules 122 include mounting contacts 124 and 125, respectively, extending therefrom. In the illustrated embodiment, each ground plate 120 and contact module 122 includes four mounting contacts 124, 125. The mounting contacts 125 correspond to four conductive leads 126 (shown in FIG. 6) extending through the contact modules 122. The mounting contacts 125 extending from the contact modules 122 are formed as part of the conductive leads 126 extending through the contact modules 122. The number of conductive leads 126 corresponds to the number of secondary substrates configured to be received in the mating end 116 of the connector 100. In particular, two conductive leads 126, and subsequently, two mounting contacts 125 are provided for each secondary substrate. As such, the number of mounting contacts 125 extending from each contact module 122, respectively, may vary based on the number of secondary substrates configured to be received by the connector 100.

The mounting contacts 124, 125 extend from the mounting end 114 of the connector 100. The mounting contacts 124, 125 are configured to be coupled to the primary substrate to electrically couple the connector 100 to the primary substrate. In the exemplary embodiment, the mounting contacts 124, 125 are compliant pins, such as eye-of-the-needle contacts, that are configured to be press-fit into vias formed in the primary substrate. Alternatively, the mounting contacts 124, 125 may be formed as any suitable contacts configured to couple to a substrate including surface mount tails, or other types of contacts.

The ground plates 120 and the contact modules 122 also include mating contacts 128 and 129, respectively, (shown in FIGS. 2, 3, 4 and 7) extending therefrom. The mating contacts 128, 129 are positioned at the mating end 116 of the connector 100. The mating contacts 128, 129 are configured to electrically couple the connector 100 to a secondary substrate. The mating contacts 129 extending from the contact modules 122 are formed as part of the conductive leads 126 extending through the contact modules 122.

The side 104 of the housing 102 includes a plurality of housing openings 130 extending therethrough. The housing openings 130 are configured to align with ground channels 132 (shown in FIGS. 4-6) to facilitate conductively coupling the ground plates 120, as described below in more detail. In an exemplary embodiment, the side 106 of the housing 102 may include openings (not shown) aligned with the housing openings 130 and the ground channels 132 so that the ground channels extend entirely through the housing 102. Alternatively, the side 106 of the housing 102 may not include openings so that the ground channels 132 are closed at the side 106 of the housing 102. In an exemplary embodiment, a conductive elastomeric material 182 (shown in FIGS. 5 and 6) extends through the housing openings 130 and into the ground channels 132 to electrically couple the ground plates 120. The housing openings 130 may be capped and/or otherwise sealed after the conductive elastomeric material 182 is inserted therein.

Figure 2:
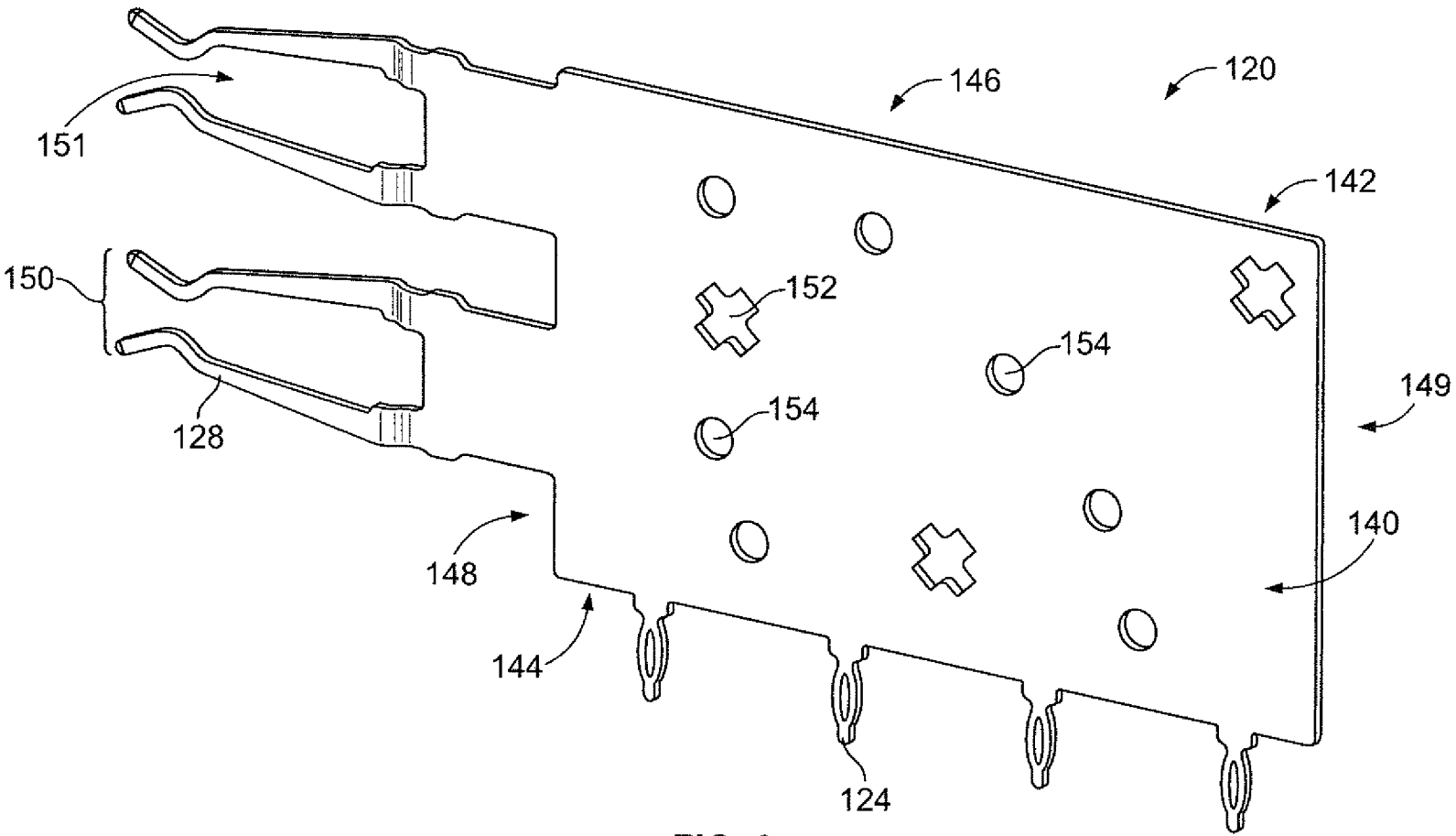
FIG. 2 is a side perspective view of a ground plate formed in accordance with an embodiment.

FIG. 2 is a side perspective view of a ground plate 120. The ground plate 120 may be formed from a conductive material, such as copper. The ground plate 120 includes a side 140 and a side 142. A bottom 144 and a top 146 extend between the side 140 and the side 142. A front 148 and a back 149 also extend between the side 140 and the side 142. The mounting contacts 124 extend from the bottom 144 of the ground plate 120 and the mating contacts 128 extend from the front 148 of the ground plate 120. Other configurations other than a right angle configuration are possible in alternative embodiments. The mating contacts 128 are arranged in sets 150. A receptacle 151 is defined between the mating contacts 128 of each set 150. Each set 150 is configured to receive a secondary substrate in the receptacle 151. In the illustrated embodiment, one of the mating contacts 128 of each set 150 of mating contacts 128 is configured to engage a top side of the secondary substrate and the other of the mating contacts 128 of the set 150 is configured to engage a bottom side of the secondary substrate. Optionally, the mating contacts 128 may be deflected when mated with the secondary substrate to spring bias the mating contacts 128 against the secondary substrate.

A plurality of alignment apertures 152 extend through the ground plate 120. The alignment apertures 152 are configured to align with corresponding posts 164 (shown in FIG. 3) formed on the contact modules 122 (shown in FIG. 1). The alignment apertures 152 and posts 164 align the ground plates 120 and the contact modules 122 to align the mounting contacts 124, 125 and the mating contacts 128, 129 of the ground plates 120 and contact modules 122, respectively.

A plurality of ground plate openings 154 also extend through the ground plate 120. The ground plate openings 154 are configured to align with ground plate openings 154 formed in other ground plates 120 and contact module openings 156 (shown in FIG. 3) formed in each contact module 122. The ground plate openings 154 and the contact module openings 156 form the ground channels 132 (shown in FIGS. 3-5) extending through the contact assembly 118. The ground plate openings 154 are also configured to align with the housing openings 130 formed in the housing 102 (both shown in FIG. 1). The ground channels 132 are accessible through the housing openings 130 in the housing 102.

Figure 3:
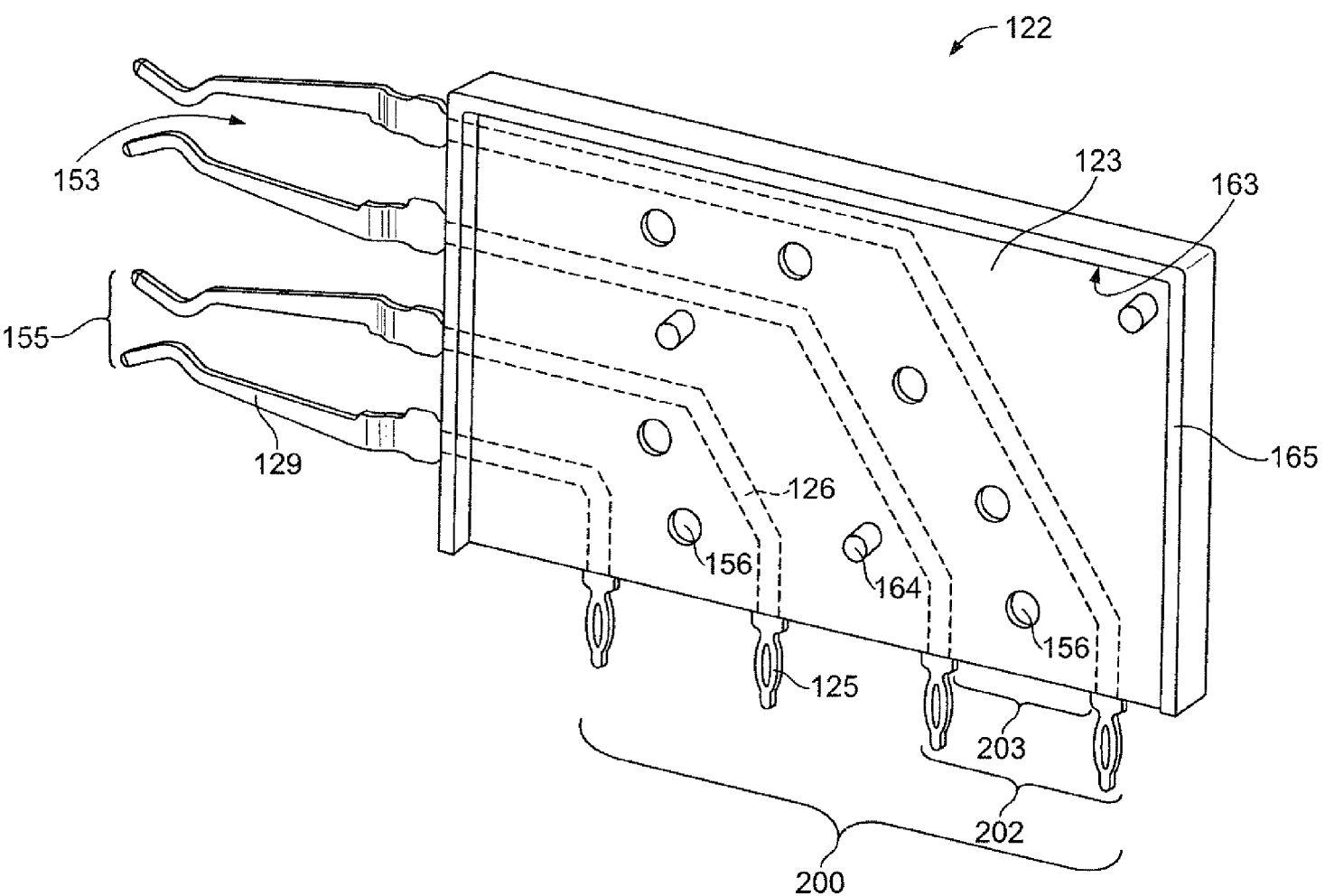
FIG. 3 is a side perspective view of a contact module formed in accordance with an embodiment.

FIG. 3 is a side perspective view of a contact module 122. The contact modules 122 include a dielectric body 123 that holds a contact lead frame 200. The contact lead frame 200 is encased in the dielectric body 123. The dielectric body 123 may be overmolded to insulate the contact lead frame 200. In one embodiment, the dielectric body 123 may be a two-part body that is snapped together around the contact lead frame 200. The contact lead frame 200 may also be overmolded with a dielectric material, for example, plastic or rubber. The mounting contacts 125 extend from the contact lead frame 200 through the dielectric body 123. The mounting contacts 125 extend from the mounting end 114 of the housing 102 for attachment to the primary substrate. The mating contacts 129 extend from the contact lead frame 200 through the dielectric body 123 for attachment to the secondary substrates.

The contact lead frame 200 includes a plurality of conductive leads 126 terminating at one end with a mating contact 129 and terminating at the other end with the corresponding mounting contact 125. The contact lead frame 200 includes two sets 202 of conductive leads 126. In one embodiment, each set 202 of conductive leads 126 is configured to mate with the same secondary substrate. For example, one conductive lead 126 of the set 202 mates with the top of the secondary substrate and the other conductive lead 126 of the set 202 mates with the bottom of the secondary substrate. Alternatively, the set may carry and transmit differential signals and each set 202 of conductive leads 126 comprises a differential pair. Each differential pair includes a conductive lead 126 having a positive polarity and a conductive lead 126 having a negative polarity. A gap 203 is formed between the conductive leads 126 of the each set 202.

The contact modules 122 include contact module openings 156 extending therethrough. The contact module openings 156 are aligned with the ground plate openings 154 formed in the ground plates 120 to form the ground channels 132 through the contact assembly 118. The contact module openings 156 extend through the gaps 203 formed between the conductive leads 126 of each set 202. Optionally, the contact module opening 156 may also be provided in the gap between the sets. In the illustrated embodiment, the contact module openings 156 are positioned equidistantly from each of the conductive leads 126 of each set 202. Optionally, the contact module openings 156 may be formed at any intermediate position between the conductive leads 126 within the gap 203.

In an exemplary embodiment, the dielectric body 123 includes a pocket 163 that receives a corresponding ground plate 120. The contact modules 122 include posts 164 extending therefrom. The posts 164 are received in the apertures 152 of the ground plate 120 to align the ground plate 120 in the pocket 163 and couple the ground plate 120 to the contact module 122. The ground plate 120 may be secured to the posts 164 through an interference fit. The pocket 163 is defined by a flange 165. Optionally, the ground plate 120 may engage the flange 165 to position and/or secure the ground plate 120 to the contact module 122. In an exemplary embodiment, the other contact module 122 within the unit (ground plate 120, contact module 122, contact module 122) does not include a pocket, but rather, has a planar side that abuts against the planar side of the contact module 122 opposite the pocket 163. Such contact module 122 has two planar sides and no flanges.

The mating contacts 129 are arranged in sets 155. A receptacle 153 is defined between the mating contacts 129 of each set 155. Each set 155 is configured to receive a secondary substrate in the receptacle 153. In the illustrated embodiment, one of the mating contacts 129 of each set 155 of mating contacts 129 is configured to engage a top side of the secondary substrate and the other of the mating contacts 129 of the set 155 is configured to engage a bottom side of the secondary substrate. Optionally, the mating contacts 129 may be deflected when mated with the secondary substrate to spring bias the mating contacts 129 against the secondary substrate.

Figure 4:
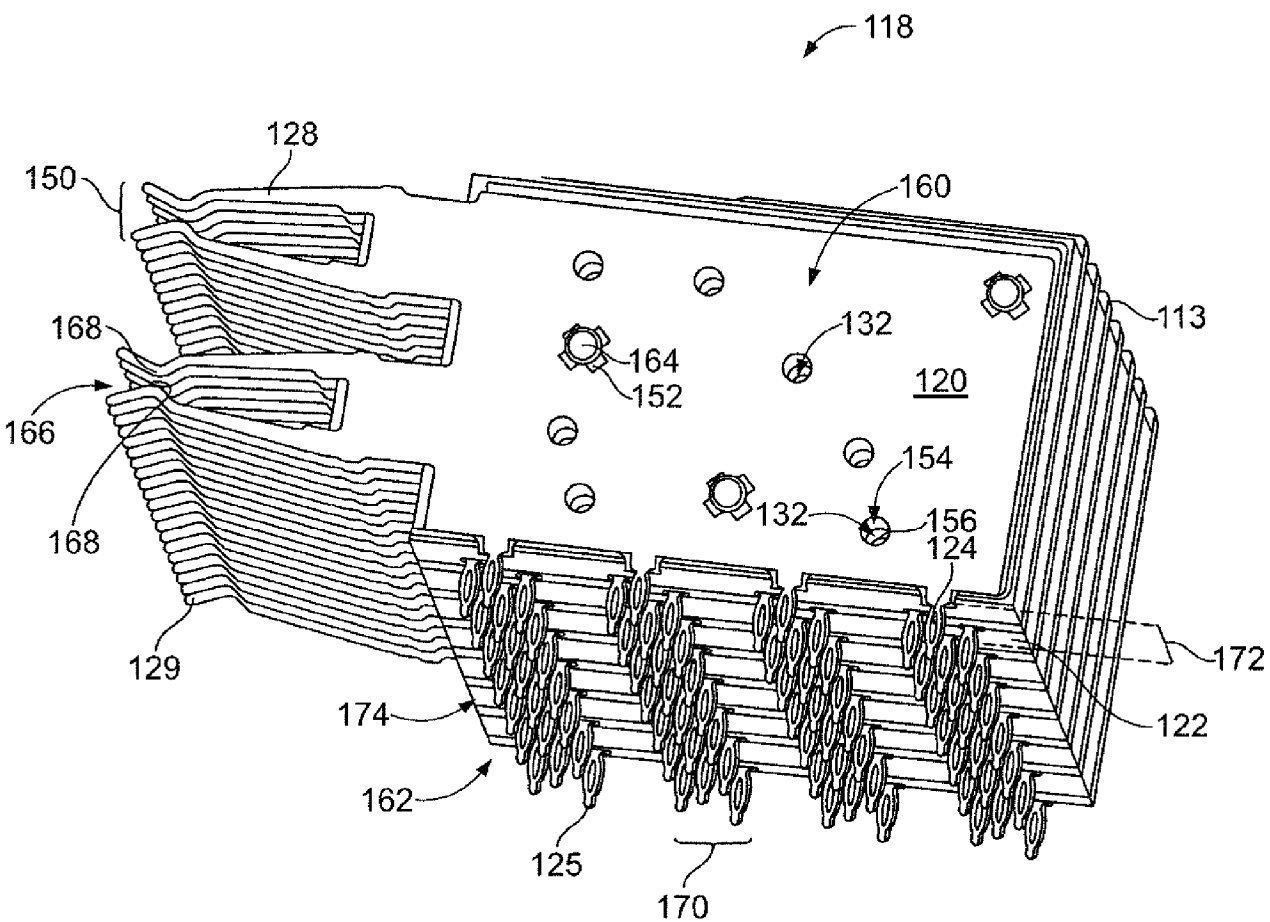
FIG. 4 is a side perspective view of a contact assembly formed in accordance with an embodiment.

FIG. 4 is a top perspective view of the contact assembly 118. The contact assembly includes a side 160 and a side 162. The contact assembly 118 includes a plurality of ground plates 120 and contact modules 122 that may be positioned adjacent to one another between the side 160 and the side 162, as described in FIG. 1. The contact assembly 118 is configured to be inserted into the cavity 109 of the housing 102 (both shown in FIG. 1) through the openings 115 and 117 (both shown in FIG. 1) formed in the housing 102. The contact assembly 118 may include flanges 113 that are configured to engage slots (not shown) formed within the cavity 109 along the top 110 (shown in FIG. 1) of the housing 102. The flanges 113 may align the contact assembly 118 within the housing 102.

The ground channels 132 extend through the contact assembly 118. In the exemplary embodiment, the ground channels 132 are cylindrical. Alternatively, the ground channels 132 may have a rectangular cross-sectional shape and/or any other suitable cross-sectional shape. The ground channels 132 extend between the side 160 and side 162 of the contact assembly 118. The ground channels 132 are formed by the ground plate openings 154 and the contact module openings 156.

The mating contacts 128, 129 extend from the contact assembly in the sets 150 and 155, respectively. The sets 150 and 155 of mating contacts 128, 129, respectively form ports 166. The receptacles 151 and 153 form the ports 166. The ports 166 extend between the sides 160 and 162 of the contact assembly 118. The ports 166 are configured to receive a secondary substrate therein. Each mating contact 128, 129 includes a mating interface 168 that extends into the port 166. The mating interfaces 168 of the mating contacts 128, 129 in each port 166 are aligned and extend toward one another. When the secondary substrate is inserted into the port 166, the substrate may be retained between the mating interfaces 168 of the mating contacts 128, 129. The secondary substrate may include contact pads (not shown) that are engaged by the mating interfaces 168 of the mating contacts 128, 129 to electrically couple the secondary substrate to the ground plates 120 and the conductive leads 126 within the contact assembly 118.

The mounting contacts 124, 125 extending from each ground plate 120 and contact module 122, respectively, are aligned in rows 170. Each ground plate 120 and contact module 122 is illustrated having four mounting contacts 124, 125 extending therefrom. The mounting contacts 124, 125 are aligned to form four rows 170. In an exemplary embodiment, the ground plates 120 and contact modules 122 are positioned in groups 172 having one ground plate 120 and two contact modules 122. The mounting contacts 124, 125 of the ground plate 120 and each contact module 122, respectively, are offset along a front 174 of the contact assembly 118. The mounting contacts 124 of the ground plates 120 of each group 172 are aligned along the front 174 of the contact assembly 118 with the corresponding mounting contacts 124 of the ground plates 120 of each other group 172. The mounting contacts 125 of the contact modules 122 of each group 172 are aligned along the front 174 of the contact assembly 118 with the corresponding mounting contacts 125 of the corresponding contact modules 122 in each other group 172.

Figure 5:
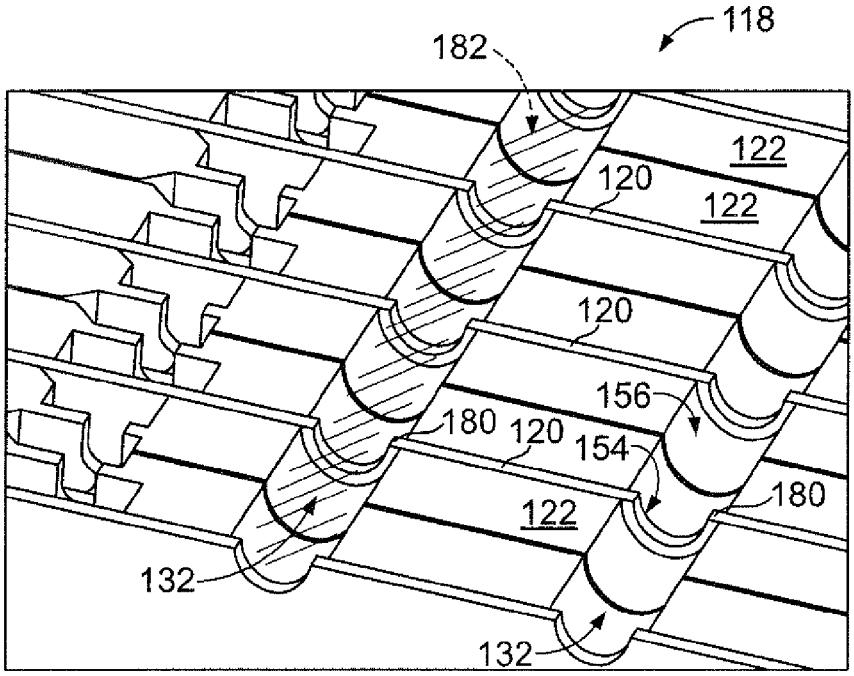
FIG. 5 is a cut-away view of the contact assembly shown in FIG. 3.

FIG. 5 is a cut-away view of the contact assembly 118. The contact assembly 118 includes a plurality of ground plates 120 and contact modules 122. At least one contact module 122 is positioned between each adjacent ground plate 120. In the illustrated embodiment, two contact modules 122 are positioned between each ground plate 120. The contact modules 122 may be formed from a dielectric material. For example, the contact modules 122 may be overmolded with plastic, rubber, or the like. The ground plates 120 are not insulated in the illustrated embodiment. The ground plates 120 are formed from a conductive material, for example, copper or the like.

The ground plate openings 154 of the ground plates 120 are aligned with the contact module openings 156 of the contact modules 122. The openings 154 and 156 form ground channels 132 through the contact assembly 118. In the illustrated embodiment, the ground plate opening 154 of each ground plate 120 is smaller than the contact module openings 156 in each contact module 122. For example, the ground plate openings 154 have a smaller diameter than the contact module openings 156. As such, an edge 180 of each ground plate 120 extends into the ground channel 132.

A conductive elastomeric material 182 is disposed within the ground channels 132. In the illustrated embodiment, the conductive elastomeric material 182 is only shown in one of the ground channels 132. The conductive elastomeric material 182 is impregnated with conductive particles to improve conductive properties of the conductive elastomeric material 182. For example, the conductive elastomeric material 182 may be impregnated with conductive metal particles, for example copper particles. The conductive elastomeric material 182 is capable of conducting electricity therethrough. The conductive elastomeric material 182 is extruded into the ground channels 132 formed through the contact assembly 118. In an exemplary embodiment, the conductive elastomeric material 182 is extruded into the ground channels 132 in a gel-like form. The conductive elastomeric material 182 may be a conductive epoxy. Alternatively, the conductive elastomeric material 182 may be disposed in the ground channels 132 as a conductive foam or other suitable pliable material. The conductive elastomeric material 182 dries and hardens within the ground channels 132. The conductive elastomeric material 182 may be configured to expand throughout the ground channels 132 prior to hardening. In an exemplary embodiment, the conductive elastomeric material 182 is extruded into the ground channels 132 after the contact assembly 118 has been inserted into the housing 102 (shown in FIG. 1). In such an embodiment, the conductive elastomeric material 182 may be extruded through the housing openings 130 (shown in FIG. 1) in the housing 102. Optionally, the conductive elastomeric material 182 may be disposed through the ground channels 132 before the contact assembly 118 is inserted into the housing 102.

The conductive elastomeric material 182 adheres to and is conductively coupled to each of the ground plates 120 in the contact assembly 118. In an exemplary embodiment, the edges 180 of the ground plates 120 may increase a contact area between the ground plates 120 and the conductive elastomeric material 182. For example, because the edge 180 and sides of the ground plates 120 are not insulated, conductive coupling with the conductive elastomeric material 182 is achieved. In an alternative embodiment, the ground plates 120 may be insulated and/or overmolded, while having the edges 180 of the ground plates 120 exposed to conductively couple with the conductive elastomeric material 182. Because the contact modules 122 may be insulated and/or overmolded, the conductive elastomeric material 182 does not conductively couple to the contact modules 122.

The conductive elastomeric material 182 conductively couples each of the ground plates 120 within the connector 100 (shown in FIG. 1). However, the contact modules 122 in the connector 100 remain insulated from the ground plates 120. As such, the conductive leads 126 (shown in FIG. 3) remain insulated from the ground plates 120. Conductively coupling the ground plates 120 within the connector 100 may improve the performance of the connector 100. For example, conductively coupling the ground plates 120 may improve grounding and/or shielding between the conductive leads 126 of the connector 100. Each of the ground plates 120 may be electrically commoned at different locations between the mating end 116 and the mounting end 114. In another embodiment, conductively coupling the ground plates 120 may reduce cross-talk within the connector 100, and in particular, between the conductive leads 126.

Figure 6:
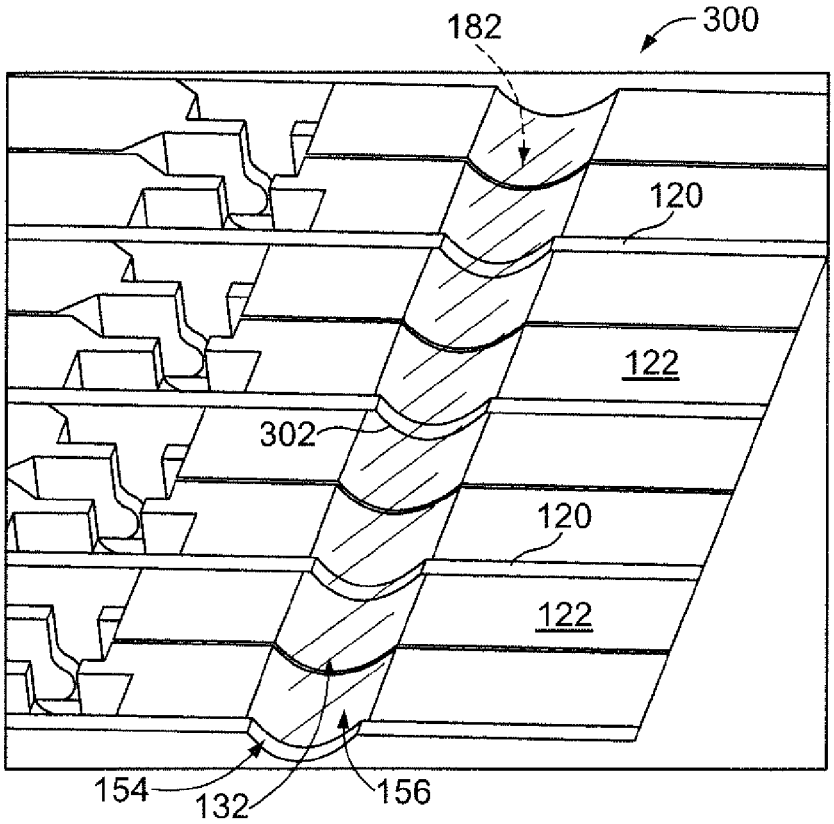
FIG. 6 is a cut-away view of an alternative contact assembly formed in accordance with an embodiment.

FIG. 6 is a cut-away view of an alternative contact assembly 300 formed in accordance with an embodiment. The contact assembly 300 includes a plurality of ground plates 120 and contact modules 122. At least one contact module 122 is positioned between each adjacent ground plate 120. In the illustrated embodiment, two contact modules 122 are positioned between each ground plate 120. The contact modules 122 may be formed from a dielectric material. For example, the contact modules 122 may be overmolded with plastic, rubber, or the like. The ground plates 120 are not insulated in the illustrated embodiment. The ground plates 120 are formed from a conductive material, for example, copper or the like.

The ground plate openings 154 of the ground plates 120 are aligned with the contact module openings 156 of the contact modules 122. The openings 154 and 156 form ground channels 132 through the contact assembly 118. The conductive elastomeric material 182 is disposed within the ground channels 132. In the illustrated embodiment, the ground plates 120 (shown in FIG. 5) do not include an edge 180 (shown in FIG. 4). Rather, the ground plates 120 are flush with the contact modules 122 throughout the ground channels 132 so that the conductive elastomeric material may be disposed evenly through the ground channels 132. The conductive elastomeric material 182 is impregnated with conductive particles to improve conductive properties of the conductive elastomeric material 182. For example, the conductive elastomeric material 182 may be impregnated with conductive metal particles, for example copper particles. The conductive elastomeric material 182 is capable of conducting electricity therethrough. The conductive elastomeric material 182 is extruded into the ground channels 132 formed through the contact assembly 118. In an exemplary embodiment, the conductive elastomeric material 182 is extruded into the ground channels 132 in a gel-like form. Alternatively, the conductive elastomeric material 182 may be disposed in the ground channels 132 as a conductive foam or other suitable pliable material. The conductive elastomeric material 182 dries and hardens within the ground channels 132. The conductive elastomeric material 182 may be configured to expand throughout the ground channels 132 prior to hardening.

The conductive elastomeric material 182 adheres to and is conductively coupled to each of the ground plates 120 in the contact assembly 118. Because the ground plates 120 are not insulated, conductive coupling with the conductive elastomeric material 182 is achieved. In an alternative embodiment, the ground plates 120 may be insulated and/or overmolded, while having an inner surface 302 of the ground plates 120 exposed to conductively couple with the conductive elastomeric material 182. Because the contact modules 122 and/or conductive leads 126 (shown in FIG. 3) may be insulated and/or overmolded, the conductive elastomeric material 182 does not conductively couple to the conductive leads 126.

The conductive elastomeric material 182 conductively couples each of the ground plates 120 within the connector 100 (shown in FIG. 1). However, the conductive leads 126 in the connector 100 remain insulated from the ground plates 120. Conductively coupling the ground plates 120 within the connector 100 may improve the performance of the connector 100. For example, conductively coupling the ground plates 120 may improve grounding and/or shielding between the conductive leads 126 of the connector 100. In another embodiment, conductively coupling the ground plates 120 may reduce cross-talk within the connector 100, and in particular, between the conductive leads 126.

Figure 7:
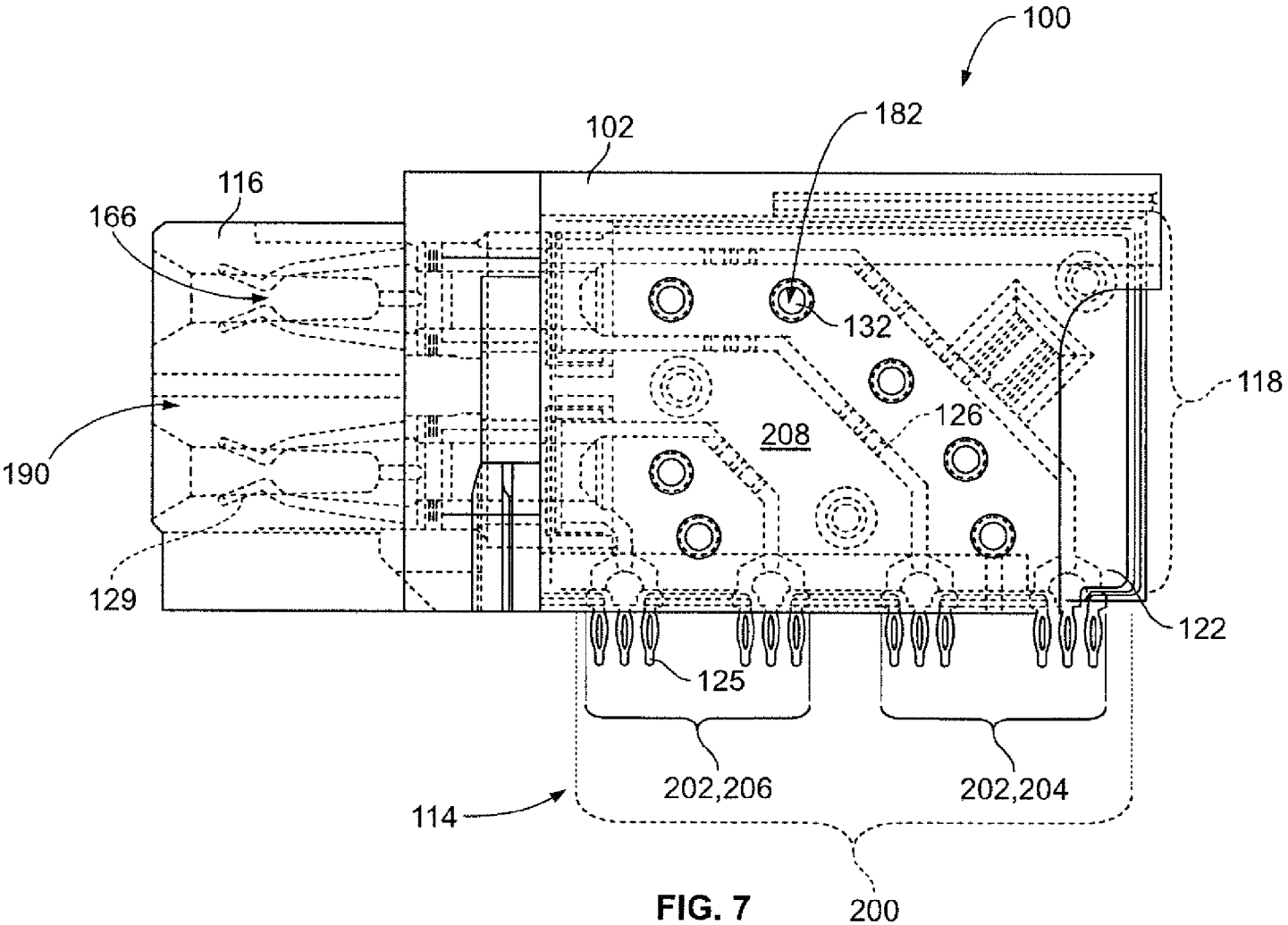
FIG. 7 is a side view of the multiport connector shown in FIG. 1 and having the contact assembly shown in phantom.

FIG. 7 is a side view of the connector 100. The connector 100 is illustrated as a multiport connector. In particular, the connector 100 is illustrated as a two port connector 100. The contact assembly 118 is positioned within the housing 102. FIG. 7 illustrates the contact assembly 118 in phantom.

The mating contacts 128, 129 are positioned within the housing 102. The mating end 116 of the housing 102 includes a cavity 190 fanned therein. The mating contacts 128, 129 extend into the cavity 190 so that the ports 166 are positioned within the cavity 190. The secondary substrates are configured to be inserted into the cavity to be positioned within the ports 166.

The ground channels 132 extend through the housing 102. The ground channels 132 extend through the ground plates 120 and the contact modules 122 such that the ground channels 132 extend through the contact lead frames 200. In the illustrated embodiment, the ground channels 132 extend between the conductive leads 126 of each set 202. Optionally, the ground channels 132 may extend through a space 208 between the sets 202. The ground channels 132 may be spaced equidistantly between the conductive leads 126 of the sets 202. Alternatively, the ground channels 132 may be located at any intermediate position between the conductive leads 126 of the sets 202. The illustrated embodiment includes five ground channels 132 located between the conductive leads 126 of a first set 204 and two ground channels 132 located between the conductive leads of a second set 206. Other embodiments may include any number of ground channels 132 located between the conductive leads 126 of the first set 204 and/or the second set 206 or within the space 208 between the first set 204 and the second set 206.

The ground channels 132 are filled with the conductive elastomeric material 182 to conductively couple the ground plates 120. Each contact module 122 may be overmolded with a dielectric material so that the conductive leads 126 do not conductively couple to the conductive elastomeric material 182. Alternatively, the contact lead frame 200 may be overmolded so that the conductive leads 126 do not conductively couple to the conductive elastomeric material 182. In an exemplary embodiment, both the contact module 122 and the lead frame 200 may be overmolded. Accordingly, the conductive elastomeric material 182 conductively couples each of the ground plates 120 without electrically coupling the ground plates 120 to the conductive leads 126 and/or electrically coupling the conductive leads 126.

The various embodiments utilize the conductive elastomeric material 182 disposed through the ground channels 132 in the connector 100. The conductive elastomeric material 182 solidifies within the ground channel 132 between the ground plates 120. The conductive elastomeric material 182 conductively couples each of the ground plates 120 within the connector 100, while the conductive leads 126 within the connector 100 remain insulated from the ground plates 120. The conductive elastomeric material 182 improves the performance of the connector 100 by improving grounding between the conductive leads 126 of the connector 100. Additionally, the conductive elastomeric material 182 may reduce cross-talk within the connector 100, and in particular, between the conductive leads 126. Moreover, the conductive elastomeric material 182 may improve shielding within the connector 100, and in particular, between the conductive leads 126.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a housing;

contact modules positioned within the housing, the contact modules each having a dielectric body holding at least one conductive lead, the at least one conductive lead extending between a mating end and a mounting end, the mating end configured to be electrically connected to at least one of an electrical component or cable, the mounting end configured to be electrically connected to at least one of a circuit board, cable or other electrical device;

ground plates positioned within the housing between corresponding contact modules, the contact modules and the ground plates forming a contact assembly held by the housing; and a conductive elastomeric material extending through the contact modules and engaging the ground plates to electrically interconnect the ground plates;

wherein the conductive elastomeric material includes at least one of a foam or a gel or epoxy.

2. The electrical connector of claim 1, wherein the conductive elastomeric material extends through ground plate channels formed in the ground plates.

3. The electrical connector of claim 1, wherein the conductive elastomeric material extends through contact module channels formed in the contact modules.

4. The electrical connector of claim 1, wherein the conductive lead is overmolded to form the dielectric body, the dielectric body electrically isolating the conductive lead from the conductive elastomeric material.

5. The electrical connector of claim 1, wherein a pair of contact modules is positioned between corresponding ground plates in the contact assembly.

6. The electrical connector of claim 1, wherein the conductive elastomeric material is impregnated with metal to improve conductive properties of the conductive elastomeric material.

7. The electrical connector of claim 1, wherein the ground plates are configured to be coupled to a ground plane of the circuit board.

8. An electrical connector comprising:

a housing;

contact modules positioned within the housing, the contact modules each having a dielectric body holding at least one conductive lead, the dielectric body having at least one contact module opening therethrough, the at least one conductive lead extending between a mating end and a mounting end, the mating end configured to be electrically connected to at least one of an electrical component or cable, the mounting end configured to be electrically connected to at least one of a circuit board, cable or other electrical device;

ground plates positioned within the housing between corresponding contact modules, the contact modules and the ground plates forming a contact assembly held by the housing, the ground plates having at least one ground plate opening therethrough, the ground plates being arranged within the contact assembly such that the contact module opening is aligned with the ground plate opening to form a ground channel extending through the ground plates and the contact modules; and a conductive elastomeric material extending through the ground channel to electrically connect the ground plates;

wherein the conductive elastomeric material includes at least one of a foam or a gel or epoxy.

9. The electrical connector of claim 8, wherein the conductive lead is overmolded to form the dielectric body, the dielectric body electrically isolating the conductive lead from the conductive elastomeric material.

10. The electrical connector of claim 8, wherein a pair of contact modules is positioned between corresponding ground plates in the contact assembly.

11. The electrical connector of claim 8, wherein the conductive elastomeric material is impregnated with metal to improve conductive properties of the conductive elastomeric material.

12. The electrical connector of claim 8, wherein the ground channel is aligned with a housing opening in the housing.

13. An electrical connector comprising:

a housing;

contact modules positioned within the housing, each contact module having a dielectric body having at least one contact module opening therethrough, a pair of conductive leads held by the dielectric body, the conductive leads being spaced by a gap, the at least one contact module opening formed in the gap between the conductive leads, the conductive leads extending between a mating end and a mounting end, the mating end configured to be electrically connected to at least one of an electrical component or cable, the mounting end configured to be electrically connected to at least one of a circuit board, cable or other electrical device;

ground plates positioned within the housing between corresponding contact modules, the contact modules and the ground plates forming a contact assembly held by the housing, the ground plates having at least one ground plate opening therethrough, the ground plates being arranged within the contact assembly such that the contact module opening is aligned with the ground plate opening to form a ground channel extending through the ground plates and the contact modules, the ground channel being positioned between the conductive leads; and a conductive elastomeric material extending through the ground channel to electrically connect the ground plates;

wherein the conductive elastomeric material includes at least one of a foam or a gel or epoxy.

14. The electrical connector of claim 13 wherein the conductive lead is overmolded to form the dielectric body, the dielectric body electrically isolating the conductive lead from the conductive elastomeric material.

15. The electrical connector of claim 13, wherein the ground channel is formed between the conductive leads and positioned equidistantly from each conductive lead.

16. The electrical connector of claim 13, wherein the ground channel extends through the housing.

17. The electrical connector of claim 13, wherein the conductive elastomeric material is impregnated with metal to improve conductive properties of the conductive elastomeric material.

* * * * *